US008248340B2

(12) United States Patent
Lu et al.

(10) Patent No.: US 8,248,340 B2
(45) Date of Patent: Aug. 21, 2012

(54) LIQUID CRYSTAL DISPLAY CAPABLE OF SPLIT-SCREEN DISPLAYING AND COMPUTER SYSTEM USING SAME

(75) Inventors: Yue-Qin Lu, Shenzhen (CN); Tong Zhou, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 679 days.

(21) Appl. No.: 12/283,822

(22) Filed: Sep. 15, 2008

(65) Prior Publication Data

US 2009/0073104 A1 Mar. 19, 2009

(30) Foreign Application Priority Data

Sep. 14, 2007 (CN) ..... 2007 1 0076998

(51) Int. Cl.
*G09G 3/36* (2006.01)

(52) U.S. Cl. ..... 345/87; 345/103

(58) Field of Classification Search ..... 345/103, 345/1.1–2.3
See application file for complete search history.

(56) References Cited

U.S. PATENT DOCUMENTS

| | | | | |
|---|---|---|---|---|
| 5,841,431 | A * | 11/1998 | Simmers | 345/211 |
| 6,362,805 | B1 * | 3/2002 | Jeong | 345/99 |
| 6,639,606 | B1 * | 10/2003 | Choi | 715/700 |
| 7,542,030 | B2 * | 6/2009 | Jang et al. | 345/204 |
| 2004/0027364 | A1 * | 2/2004 | Ohtani et al. | 345/699 |
| 2004/0150581 | A1 * | 8/2004 | Westerinen et al. | 345/1.3 |
| 2005/0017992 | A1 * | 1/2005 | Kudo et al. | 345/690 |
| 2005/0068309 | A1 * | 3/2005 | Chang et al. | 345/204 |

FOREIGN PATENT DOCUMENTS

| | | | |
|---|---|---|---|
| CN | 2708360 | Y | 7/2005 |
| JP | 9-81079 | A | 3/1997 |
| JP | 2000-315068 | A | 11/2000 |

* cited by examiner

*Primary Examiner* — Chanh Nguyen
*Assistant Examiner* — Roy Rabindranath
(74) *Attorney, Agent, or Firm* — WPAT, P.C.; Justin King

(57) ABSTRACT

An exemplary liquid crystal display includes a liquid crystal panel having at least two pixel regions, a mode selector configured to provide a mode selection signal, and a timing controller configured to receive at least two video signal sets and in response to the mode selection signal, control the liquid crystal panel to display a picture corresponding to one of the at least two video signal sets using full-screen displaying or to simultaneously display at least two pictures, each of the at least two pictures corresponding to one of the at least two video signal sets using split-screen displaying. Each of the at least two pixel regions corresponds to one of the at least two pixel regions while using the split-screen displaying. A related computer system is also provided.

18 Claims, 4 Drawing Sheets

LIQUID CRYSTAL DISPLAY CAPABLE OF SPLIT-SCREEN DISPLAYING AND COMPUTER SYSTEM USING SAME

TECHNICAL FIELD

The present disclosure relates to a liquid crystal display (LCD) capable of split-screen displaying, and also relates to a computer system using such LCD.

GENERAL BACKGROUND

LCDs are widely used in various electronic information devices, such as notebooks, personal digital assistants, video cameras, and the like. LCDs may employ a video graphic array (VGA) interface or a digital visual interface (DVI) to receive video signals provided by a computing system, and to further display images according to the video signals.

In special circumstances, such as a meeting or an exhibition, it may be needed to simultaneously display images according to video signals provided by two or more computing systems. Because the conventional LCD can only display images based on video signals outputted from a computer host one time, in this situation, a user has to provide an auxiliary LCD to meet the dual-displaying requirement. This is inconvenient for the user.

What is needed is to provide an LCD and a computer system that can overcome the limitations described.

SUMMARY

In one exemplary embodiment, a liquid crystal display includes a liquid crystal panel having at least two pixel regions, a mode selector configured to provide a mode selection signal, and a timing controller configured to receive at least two video signal sets and in response to the mode selection signal, control the liquid crystal panel to display a picture corresponding to one of the at least two video signal sets using full-screen displaying or to simultaneously display at least two pictures, each of the at least two pictures corresponding to one of the at least two video signal sets using split-screen displaying. Each of the at least two pixel regions corresponds to one of the at least two pictures while using the split-screen displaying.

Other novel features and advantages will become more apparent from the following detailed description when taken in conjunction with the accompanying drawings.

DETAILED DESCRIPTION

Reference will now be made to the drawings to describe certain inventive embodiments of the present disclosure in detail.

Figure 1:
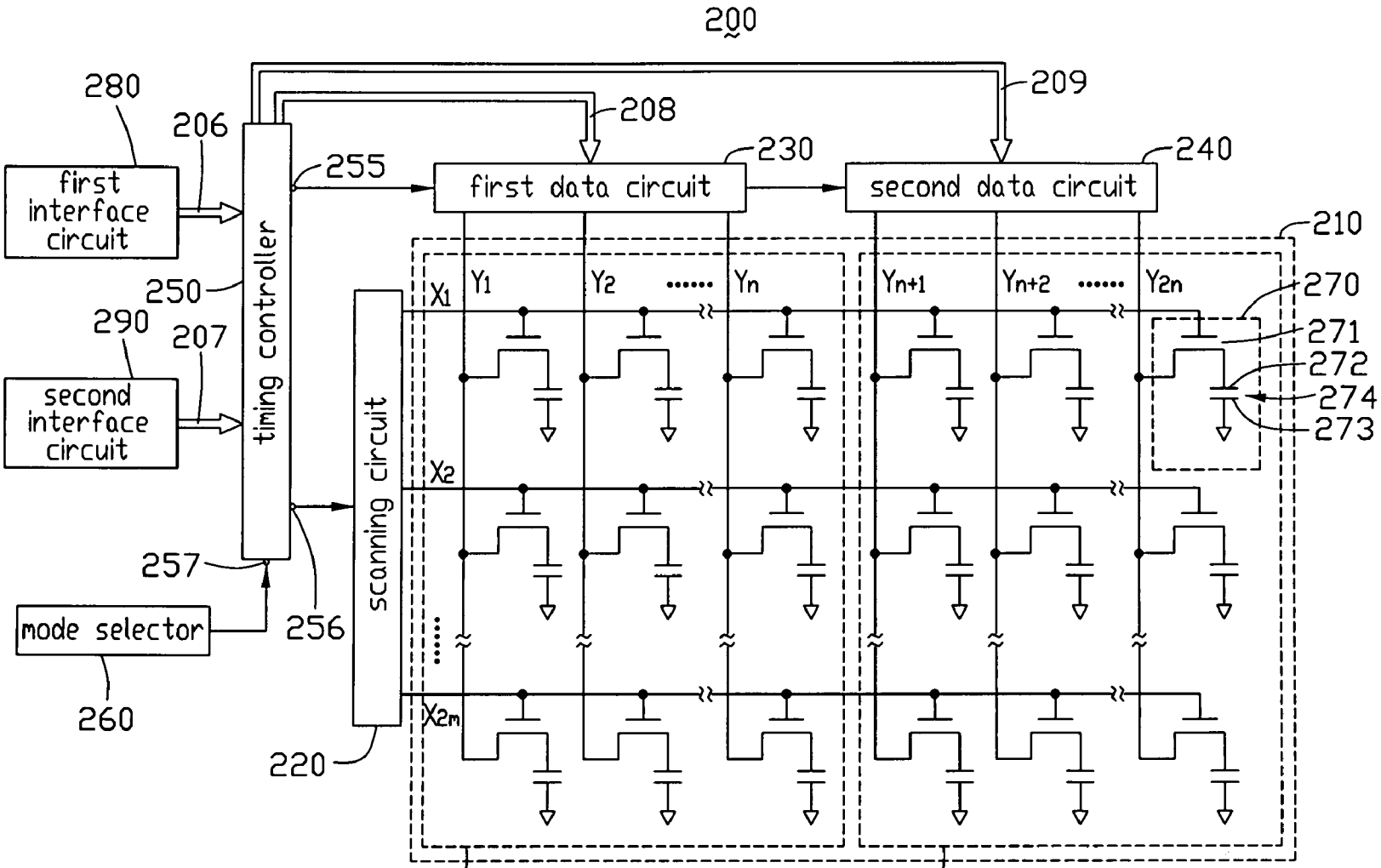
FIG. 1 is an partial circuit diagram of an LCD according to one embodiment of the present disclosure, the LCD including a timing controller and a mode selector.

FIG. 1 is an partial circuit diagram of an LCD 200 according to one embodiment of the present disclosure. In one embodiment, the LCD 200 includes a liquid crystal panel 210, a scanning circuit 220, a first data circuit 230, a second data circuit 240, a timing controller 250, a mode selector 260, a first interface circuit 280, and a second interface circuit 290.

The liquid crystal panel 210 includes 2m rows of parallel scanning lines X1-X2*m* (where m is a natural number), 2n columns of parallel data lines Y1-Y2*n* (where n is also a natural number) perpendicular to the scanning lines X1-X2*m*, and a plurality of pixel units 270 cooperatively defined by the crossing scanning lines X1-X2*m* and data lines Y1-Y2*n*. Thereby, the pixel units 270 are arranged in a matrix having 2m rows and 2n columns. The matrix is divided into a first pixel region 211 involving the first to pth ($2 \leqq p \leqq 2n-1$) columns of the pixel units 270, and a second pixel region 212 involving the (p+1)th to (2n)th columns of the pixel units 270. In the illustrated embodiment, for example, the number k is adopted to be equal to n, such that a size of the first pixel region 211 is substantially the same as that of the second pixel region 212. Thus each of the first and second pixel regions 211, 212 includes 2m×n pixel units 270, that is, a physical resolution of each of the first and second pixel regions 211, 212 is 2m×n. Moreover, the scanning lines X1-X2*m* are electrically coupled to the scanning circuit 220. The data lines Y1-Yn are electrically coupled to the first data circuit 230. The data lines Y(n+1)–Y2*n* are electrically coupled to the second data circuit 240.

Each pixel unit 270 includes a thin-film transistor (TFT) 271, a pixel electrode 272, and a common electrode 273. A gate electrode of the TFT 271 is electrically coupled to a corresponding one of the scanning lines X1-X2*m*, and a source electrode of the TFT 271 is electrically coupled to a corresponding one of the data lines Y1-Y2*n*. Further, a drain electrode of the TFT 271 is electrically coupled to the pixel electrode 272. The common electrode 273 is generally opposite to the pixel electrode 272, with a plurality of liquid crystal molecules (not shown) sandwiched therebetween, so as to cooperatively form a liquid crystal capacitor 274.

The first interface circuit 280 and the second interface circuit 290 are capable of scaling video signals applied thereto. In particular, the first interface circuit 280 is electrically coupled to a first video source (not shown) to receive a first video signal set having a first primary resolution, and the second interface circuit 290 is electrically coupled to a second video source (not shown) to receive a second video signal set having a second primary resolution. In the first interface circuit 280, the first video signal set is scaled and converted to a first k-bit low voltage differential signal (LVDS) set with a first resolution equal to the physics resolution of the first pixel region 211, that is, 2m×n. Similarly, in the second interface circuit 290, the second video signal set is scaled and converted to a second k-bit LVDS set with a second resolution equal to the physics resolution of the second pixel region 212, that is, 2m×n, too. In addition, each of the first and second video sources can be a selected one of a computer host, a disc player, a memory reader, and the like.

The timing controller 250 controls the driving timing of the scanning circuit 220, the first data circuit 230, and the second data circuit 240. The timing controller 250 includes a control terminal 257 for receiving a mode selection signal from the mode selector 260, a first output terminal 256 for outputting a first timing control signal to the scanning circuit 220, and a second output terminal 255 for outputting a second timing control signal to both the first and second data circuits 230, 240.

Figure 2:
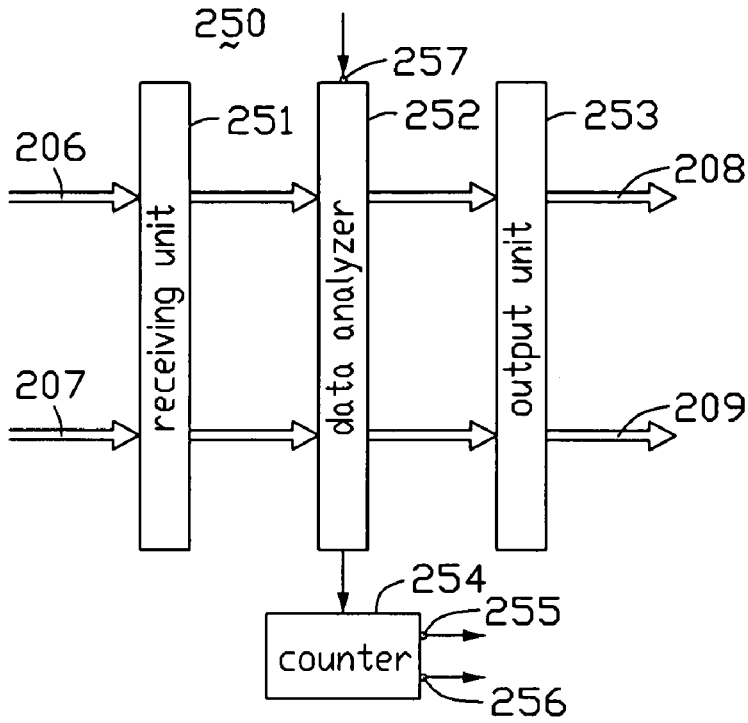
FIG. 2 is a block diagram of the timing controller of the LCD of FIG. 1.

Referring also to FIG. 2, the timing controller 250 further includes a receiving unit 251, a data analyzer 252, an output unit 253, and a counter 254. The receiving unit 251 receives the first k-bit LVDS set from the first interface circuit 280 via a first LVDS bus 206, and receives the second k-bit LVDS set from the second interface circuit 290 via a second LVDS bus 207. The data analyzer 252 selects and analyzes the first LVDS set and/or the second LVDS set according to the mode selection signal, and correspondingly generates a first k-bit signal subset, a second k-bit signal subset, and a synchronous signal. The output unit 253 converts the first and second k-bit signal subsets to a first reduced swing differential signal (RSDS) set and a second RSDS set respectively, and further outputs the first RSDS set and the second RSDS set to the first data circuit 230 and the second data circuit 240 via a first RSDS bus 208 and a second RSDS bus 209, respectively. The counter 254 generates a first timing control signal and a second timing control signal by counting the synchronous signal, and outputs the first and second timing control signal via the first and second output terminals 256, 255, respectively.

Figure 3:
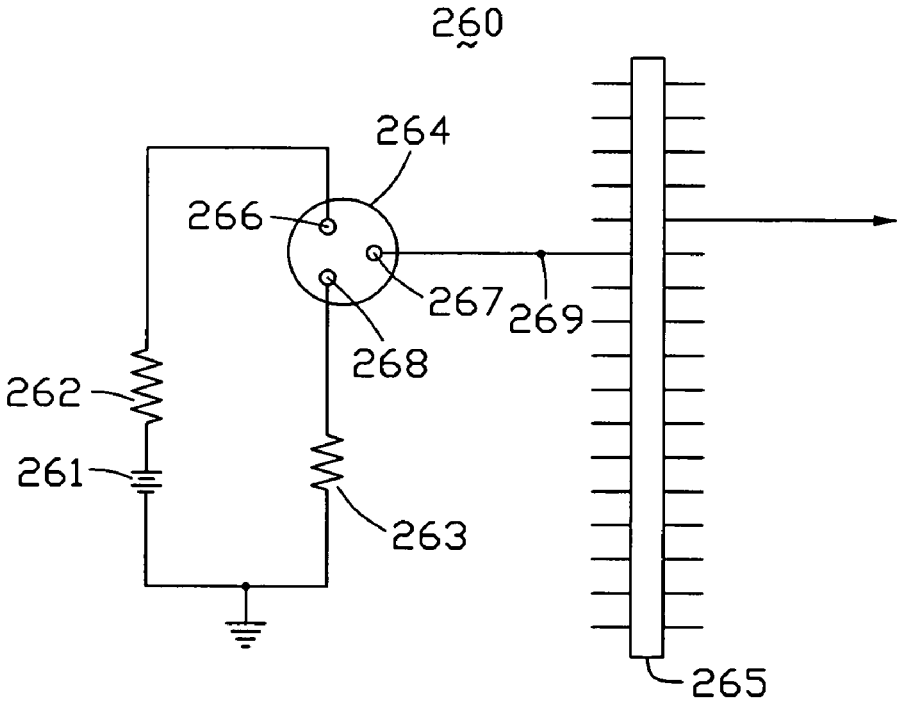
FIG. 3 schematically illustrates certain components of the mode selector of the LCD of FIG. 1.

Referring to FIG. 3, the mode selector 260, in one embodiment, includes a direct current (DC) power supply 261, a pull-up resistor 262, a pull-down resistor 263, a mode conversion switch 264, and an output terminal 269. The mode conversion switch 264 includes a first contact terminal 266 electrically coupled to the power supply 261 via the first resistor 262, a second contact terminal 267 being grounded via the pull-down resistor 268, and a third contact terminal 268 being floated. The output terminal 269 is controlled to be electrically coupled to a selected one of the first, second, and third contact terminals 266, 267, and 268 according to a selected instruction provided by a user.

In one embodiment, the output terminal 269 is electrically coupled to the control terminal 257 of the timing controller 250 via a connecter 265. However, the output terminal 269 can also be electrically coupled to the control terminal 257 directly.

Typical operation of the LCD 200 is as follows. When the user inputs an instruction indicating that a default working mode of the LCD 200 is selected, the output terminal 269 of the mode selector 260 is electrically coupled to the third contact terminal 268. Because the third contact terminal 268 is floating, a high-impedance signal is generated and outputted to the timing controller 250. The high-impedance signal serves as a first mode selection signal, and controls the data analyzer 252 to select the first k-bit LVDS set from the receiving unit 251. The data analyzer 252 then converts the first k-bit LVDS set into a first k-bit signal subset and a second k-bit signal subset.

When the user inputs an instruction indicating that a first alternative working mode is selected of the LCD 200, the output terminal 269 of the mode selector 260 is electrically coupled to the first contact terminal 266. Because the first contact terminal 266 is electrically coupled to the power supply 261, a high voltage signal is generated and outputted to the timing controller 250. The high voltage signal serves as a second mode selection signal, and controls the data analyzer 252 to select the second k-bit LVDS set from the receiving unit 251. The data analyzer 252 then converts the second k-bit LVDS set into a first k-bit signal subset and a second k-bit signal subset.

When the user inputs an instruction indicating that a second alternative working mode is selected of the LCD 200, the output terminal 269 of the mode selector 260 is electrically coupled to the second contact terminal 267. Because the second contact terminal 267 is grounded, a low voltage signal is generated and outputted to the timing controller 250. The low voltage signal serves as a third mode selection signal, and controls the data analyzer 252 to select the first k-bit LVDS set and the second k-bit LVDS set from the receiving unit 251 simultaneously. The data analyzer 252 then converts the first LVDS set into a first k-bit signal subset, and converts the second LVDS set into a second k-bit signal subset.

Whichever working mode is selected, in addition, the data analyzer 252 further synchronizes the first signal subset and the second signal subset, so as to form a synchronous signal. The first signal subset and the second signal subset are received by the output unit 253 in parallel, converted to a first RSDS set and a second RSDS set respectively, and outputted to the first data circuit 230 and the second data circuit 240, respectively. The counter 254 receives and counts the synchronous signal, so as to generate a first timing control signal and a second timing control signal, respectively. The first timing control signal is then outputted to the scanning circuit 220, and the second timing control signal is then outputted to both the first data circuit 230 and the second data circuit 240.

The scanning circuit 220 provides a plurality of scanning pulses to the scanning lines X1-X2*m* sequentially according to the first timing control signal. Thereby, the TFTs 271 of the pixel units 270 located in the corresponding row of the matrix are switched on, and the corresponding pixel units 270 are activated.

The first data circuit 230 converts the first RSDS set to a plurality of first driving voltage signals, and outputs the first driving voltage signals to the pixel electrodes 271 of the activated pixel units 270 in the first pixel region 211 via the data lines Y1-Yn. The second data circuit 230 converts the second RSDS set to a plurality of second driving voltage signals, and outputs the second driving voltage signals to the pixel electrodes 271 of the activated pixel units 270 in the second pixel region 212 via the data lines Yn+1–Y2*n*. Each of the driving voltage signals causes an electric field to be generated between the corresponding pixel electrode 272 and the common electrode 273. The electric field drives the liquid crystal molecules of the pixel unit 270 to control light transmission of the pixel unit 270, such that the pixel unit 270 displays a particular color (e.g., red, green, or blue) having a corresponding gray level. The aggregation of colors displayed by all the pixel units 270 in the first pixel region 211 simultaneously constitutes a first sub-image, and the aggregation of colors displayed by all the pixel units 270 in the second pixel region 212 simultaneously constitutes a second sub-image.

When the default working mode is selected, the first sub-image and the second sub-image cooperatively form a complete picture corresponding to the first video signal set provided by the first video source. When the first alternative working mode is selected, the first sub-image and the second sub-image cooperatively form a complete picture corresponding to the second video signal set provided by the second video source. When the second alternative working mode is selected, the first sub-image and the second sub-image are independent and respectively correspond to the first video signal set and the second video signal set. In this situation, the LCD 200 simultaneously displays two pictures using split-screen displaying, with one picture in the first region 211 and the other picture in the second region 212. Moreover, the two pictures are located along an extending direction of the scanning line X1-X2*m*.

In summary, the LCD 200 employs the mode selector 260 to provide a mode selection signal, and employs the timing controller 250 having the data analyzer 252 to analyze and convert the first LVDS set and/or the second LVDS set according to the mode selection signal. Thereby, the LCD 200 is capable of displaying video signals provided by two video sources (e.g. two computing systems) simultaneously using split-screen displaying, and the dual-displaying requirement is met without applying an auxiliary LCD that might otherwise be necessary. This improves the convenience of the LCD 200 for the user. Moreover, due to the cooperation of the mode selector 260 and the timing controller 250, the LCD 200 can further be switched to full-screening display the picture corresponding the video signal set provided by one of the video sources as desired according to the inputting instruction. That is, the LCD 200 can be controlled to switch between full-screen displaying and split-screen displaying based on the viewing requirement of the user. This enables the LCD 200 to be applied in different kinds of circumstance.

Figure 4:
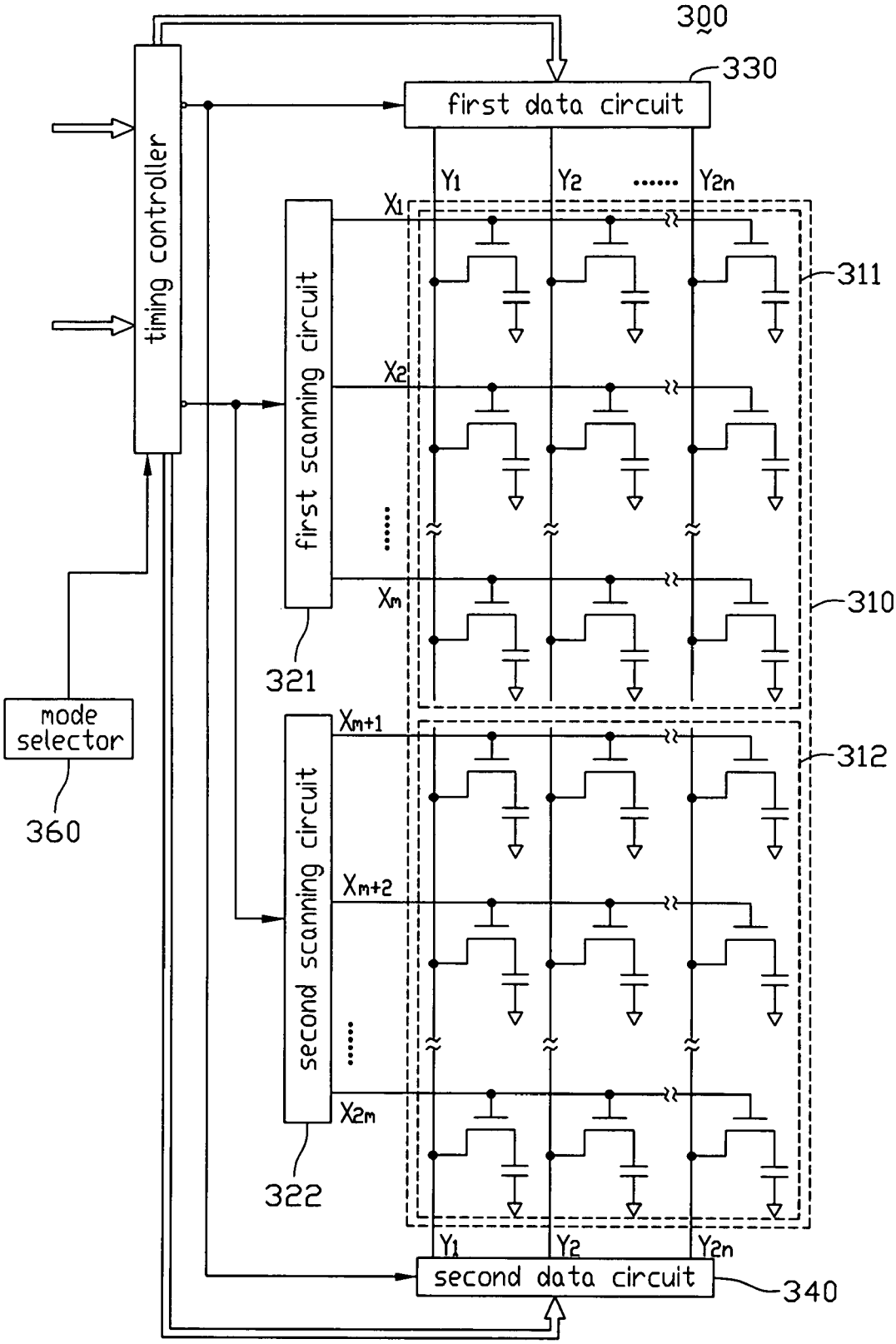
FIG. 4 is an partial circuit diagram of an LCD according to another embodiment of the present disclosure.

FIG. 4 is an partial circuit diagram of an LCD 300 according to another embodiment of the present disclosure. The LCD 300 may be substantially similar to the LCD 200, differing in that the LCD 300 includes a liquid crystal panel 310, a first scanning circuit 321, and a second scanning circuit 322. The liquid crystal panel 310 includes 2m rows of scanning lines X1-X2*m*, 2n columns of data lines Y1-Y2*n*, and a plurality of pixel units (not labeled) arranged in a matrix. The pixel units located in the first to (m)th rows of the matrix define a first pixel region 311, and the pixel units located in the (m+1)th to (2m)th row of the matrix define a second pixel region 312. Each of the data lines Y1-Y2*n* are divided into a first sub-line and a second sub-line. The first sub-line is used to transmit a data voltage signal provided by a first data circuit 330 to the corresponding pixel unit in the first pixel region, and the second sub-line is used to transmit a data voltage signal provided by a second data circuit 340 to the corresponding pixel unit in the second pixel region. Moreover, the first and second scanning circuits 321, 322 are configured to activate the pixel units in the first and second pixel regions 311, 312, respectively.

With this configuration, by providing a corresponding instruction to a mode selector 360, the LCD 300 can be controlled to display two pictures corresponding to video signals provided to two video signals sources simultaneously using split-screen displaying, with the two pictures being located along the data lines Y1-Y2*m*.

In alternatively embodiments, the liquid crystal panels 210, 310 can be divided into a plurality of pixel regions, and mode selectors 260, 360 can be defined to have a plurality of working modes, such that while being used in one of the working mode, the LCDs 200, 300 can simultaneously displays a plurality of video signals provided by a plurality of video signal sources by split-screen displaying. That is, the number of split-screen of the LCDs 200, 300 can be expanded as desired.

Figure 5:
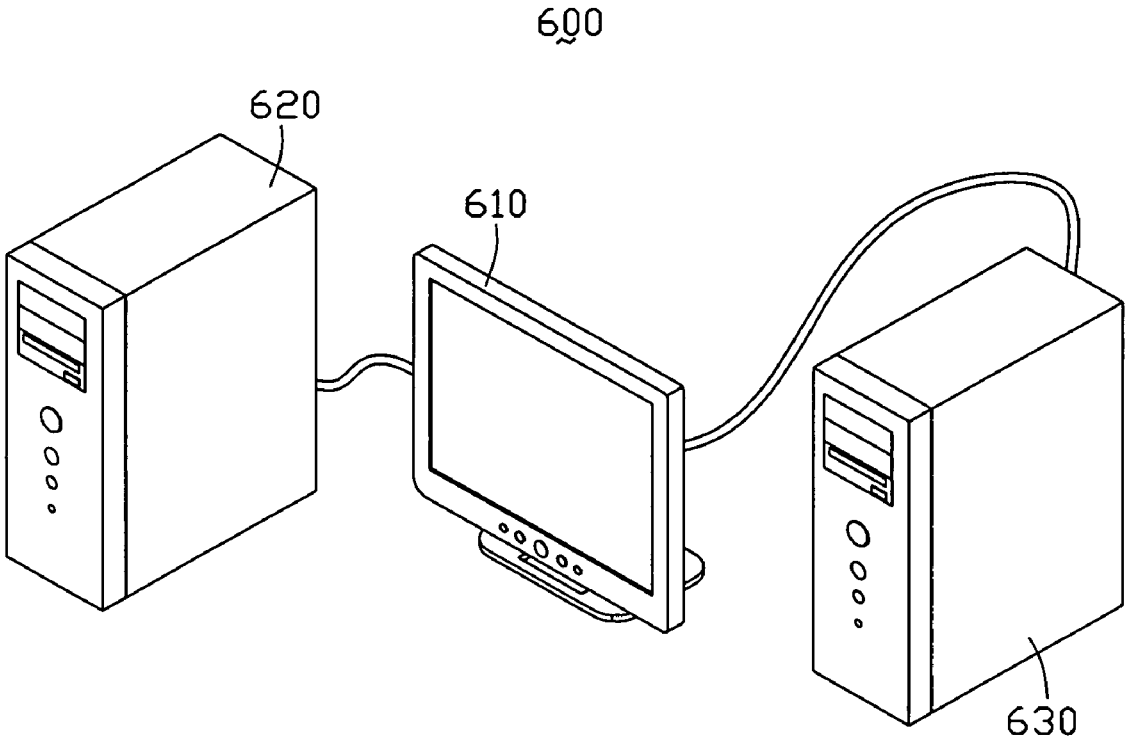
FIG. 5 illustrates one embodiment of a computer system according to the present disclosure for split-screen viewing.

FIG. 5 illustrates one embodiment of a computer system 600 according to the present disclosure for split-screen viewing. The computer system 600 includes an LCD 610, a first computer host 620, and a second computer host 630. The LCD 610 can employ one of the above-described LCDs 200 and 300, and includes a first interface circuit (not visible) and a second interface circuit (not visible). The first and second computing systems 620, 630 serve as a first video signal source and a second video signal source, and are electrically coupled to the first interface circuit and the second interface circuit, respectively. With this configuration, according to an instruction provided by a user, the LCD 610 can display video signals provided by one of the computing systems 610, 620 using full-screen displaying, or simultaneously display the video signals provided by both the first and second computing systems 610, 620 using split-screen displaying.

It is to be further understood that even though numerous characteristics and advantages of preferred and exemplary embodiments have been set out in the foregoing description, together with details of structures and functions associated with the embodiments, the disclosure is illustrative only; and that changes may be made in detail (including in matters of arrangement of parts) within the principles of the invention to the full extent indicated by the broad general meaning of the terms in which the appended claims are expressed.

What is claimed is:

1. A liquid crystal display, comprising:

a liquid crystal panel comprising at least two pixel regions;

a mode selector configured to provide a first or second mode selection signal; and a timing controller configured to receive at least two video signal sets and in response to the first or second mode selection signal, control the liquid crystal panel to display a picture corresponding to one of the at least two video signal sets using full-screen displaying or to simultaneously display at least two pictures, each of the at least two pictures corresponding to one of the at least two video signal sets using split-screen displaying;

wherein each of the at least two pixel regions corresponds to one of the at least two pictures while using the split-screen displaying, the mode selector comprises a power supply, a first resistor, a second resistor, a mode conversion switch, and an output terminal for outputting the first or second mode selection signal, the mode conversion switch comprises a first contact terminal, a second contact terminal, and a third contact terminal, one end of the first resistor is connected to the first contact terminal, the other end of the first resistor is connected to a positive terminal of the power supply, the first contact terminal is configured for providing the first mode selection signal, one end of the second resistor is connected to the second contact terminal, the other end of the second resistor is connected to a negative terminal of the power supply, a node between the second resistor and the power supply is grounded, the second contact terminal is configured for providing the second mode selection signal, and the third contact terminal is floated, and the output terminal is electrically coupled to one of the first, second, or third contact terminals according to an input instruction.

2. The liquid crystal display of claim 1, wherein the mode selection signal is generated according to a selected instruction provided by a user.

3. The liquid crystal display of claim 1, wherein the timing controller comprises a data analyzer configured to select and analyze one of the at least two video signal sets or all the at least two video signal sets according to the mode selection signal, so as to generate at least two signal subsets.

4. The liquid crystal display of claim 3, wherein each of the at least two signal subsets and a corresponding one of the at least two video signal set are both k-bit.

5. The liquid crystal display of claim 3, wherein the timing controller further comprises a receiving unit configured to receive the at least two video signal sets in parallel.

6. The liquid crystal display of claim 3, wherein the timing controller further comprises an output unit configured to convert the at least two signal subsets to at least two reduced swing differential signal sets, and output the at least two reduced swing differential signal sets for driving the at least two pixel regions, respectively.

7. The liquid crystal display of claim 3, wherein the timing controller further comprises a counter, wherein the data analyzer generates a synchronous signal by synchronizing the at least two signal subsets, and the counter generates a first timing control signal and a second control signal according to the synchronous signal.

8. The liquid crystal display of claim 1, further comprising at least two interface circuits, each of the at least two interface circuits configured to provide one of the at least two video signal sets to the timing controller.

9. The liquid crystal display of claim 8, wherein each of the at least two video signal sets is formatted to be a low voltage differential signal set by the corresponding interface circuit before outputting to the timing controller.

10. The liquid crystal display of claim 9, wherein each of the low voltage differential signal set is scaled to having a resolution the same as a physical resolution of the corresponding one of the at least one pixel regions by the at least two interface circuits respectively.

11. The liquid crystal display of claim 1, wherein the at least two video signal sets is provided by at least two video sources, and each of the at least two video sources is one selected from a group consisting of a computer host, a disc player, and a memory reader.

12. The liquid crystal display of claim 1, wherein the at least two pixel regions comprises a first pixel region and a second pixel region, wherein the first pixel region has a size the same as that of the second pixel region.

13. A liquid crystal display, comprising:

a liquid crystal panel comprising at least two pixel regions;

a mode selector configured to provide a first or second mode selection signal; and a timing controller comprising a data analyzer;

wherein the data analyzer is configured to selectively receive at least two video signal sets according to the first or second mode selection signal, and thereby controlling the at least two pixel regions to cooperatively display a picture corresponding to a selected one of the first and second video signal sets, or to independently and simultaneously display at least two pictures, wherein each of the at least two pictures corresponds to one of the at least two video signal sets, the mode selector comprises a power supply, a first resistor, a second resistor, a mode conversion switch, and an output terminal for outputting the first or second mode selection signal, the mode conversion switch comprises a first contact terminal, a second contact terminal, and a third contact terminal, one end of the first resistor is connected to the first contact terminal, the other end of the first resistor is connected to a positive terminal of the power supply, the first contact terminal is configured for providing the first mode selection signal, one end of the second resistor is connected to the second contact terminal, the other end of the second resistor is connected to a negative terminal of the power supply, a node between the second resistor and the power supply is grounded, the second contact terminal is configured for providing the second mode selection signal, and the third contact terminal is floated, and the output terminal is electrically coupled to one of the first, second, or third contact terminals according to an input instruction.

14. The liquid crystal display of claim 13, wherein the mode selection signal is generated according to a selected instruction provided by a user.

15. The liquid crystal display of claim 13, wherein each of first and second signal subsets and the corresponding one of the at least two video signal set are both k-bit.

16. The liquid crystal display of claim 13, wherein the timing controller further comprises a counter, wherein the data analyzer generates a synchronous signal by synchronizing the at least two signal subsets, and the counter generates a first timing control signal and a second control signal according to the synchronous signal.

17. A computer system, comprising:

a first computing system configured to provide a first video signal set;

a second computing system configured to provide a second video signal set; and a liquid crystal display, the liquid crystal display comprising a liquid crystal panel having at least two pixel regions, a mode selector configured to provide a first or second mode selection signal, and a data analyzer;

wherein the data analyzer is configured to receive the first video signal set or/and the second video signal set according to the first or second mode selection signal, and correspondingly generate a first signal subset and a second signal subset to control the at least two pixel regions to cooperatively display a picture corresponding to the selected one of the first and second video signal sets, or to independently display two pictures each corresponding to one of the first and second video signal sets, the mode selector comprises a power supply, a first resistor, a second resistor, a mode conversion switch, and an output terminal for outputting the first or second mode selection signal, the mode conversion switch comprises a first contact terminal, a second contact terminal, and a third contact terminal, one end of the first resistor is connected to the first contact terminal, the other end of the first resistor is connected to a positive terminal of the power supply, the first contact terminal is configured for providing the first mode selection signal, one end of the second resistor is connected to the second contact terminal, the other end of the second resistor is connected to a negative terminal of the power supply, a node between the second resistor and the power supply is grounded, the second contact terminal is configured for providing the second mode selection signal, and the third contact terminal is floated, and the output terminal is electrically coupled to one of the first, second, or third contact terminals according to an input instruction.

18. The computer system of claim 17, wherein the mode selection signal is generated according to a selected instruction provided by a user.

* * * * *